US009784076B2

(12) United States Patent
Bjorge et al.

(10) Patent No.: US 9,784,076 B2
(45) Date of Patent: Oct. 10, 2017

(54) GAS COMPRESSION SYSTEM

(71) Applicant: STATOIL PETROLEUM AS, Stavanger (NO)

(72) Inventors: Tor Bjorge, Hundhamaren (NO); Lars Brenne, Sandnes (NO); Harald Underbakke, Sandnes (NO); Bjorn-André Egerdahl, N-Røyneberg (NO); Rune Mode Ramberg, Sandnes (NO); William Bakke, Røyken (NO)

(73) Assignee: STATOIL PETROLEUM AS, Stavanger (NO)

( * ) Notice: Subject to any disclaimer, the term of this patent is extended or adjusted under 35 U.S.C. 154(b) by 23 days.

(21) Appl. No.: 14/696,008

(22) Filed: Apr. 24, 2015

(65) Prior Publication Data

US 2015/0322763 A1 Nov. 12, 2015

Related U.S. Application Data

(63) Continuation of application No. 12/988,769, filed as application No. PCT/NO2009/000126 on Apr. 2, 2009, now Pat. No. 9,032,987.

(30) Foreign Application Priority Data

Apr. 21, 2008 (NO) ..... 20081911

(51) Int. Cl.
*E21B 43/01* (2006.01)
*F04D 13/12* (2006.01)
(Continued)

(52) U.S. Cl.
CPC ..... *E21B 43/01* (2013.01); *E21B 43/36* (2013.01); *F04D 1/00* (2013.01); *F04D 13/06* (2013.01);
(Continued)

(58) Field of Classification Search
CPC ..... E21B 43/01; E21B 43/36; F04D 17/08; F04D 29/22; F04D 29/40; F04D 29/046;
(Continued)

(56) References Cited

U.S. PATENT DOCUMENTS 4,969,803 A 11/1990 Turanskyj
5,028,204 A 7/1991 Kulle et al.
(Continued)

FOREIGN PATENT DOCUMENTS

EP 0194837 A2 9/1988
EP 0381844 A2 4/1990
(Continued)

*Primary Examiner* — Jessica Cahill
*Assistant Examiner* — Ian Paquette
(74) *Attorney, Agent, or Firm* — Birch, Stewart, Kolasch & Birch, LLP

(57) ABSTRACT

A gas compression system and a method of flow conditioning by a gas compression system are provided. A gas compression system includes a compact flow conditioner in a form of a flow conditioner tank and a combined multiphase pump and compressor unit comprising an impeller configured to compress a mixture of gas and liquid, wherein the gas compression system is configured such that the gas and the liquid are separated in the flow conditioner tank, the separated gas and liquid are sucked up through the separate gas and liquid pipes and re-mixed again upstream of the impeller, and the liquid is distributed in a gas flow by Venturi effect, and wherein the Venturi effect is obtained by a constriction in the outlet pipe to the impeller, just upstream of the impeller.

10 Claims, 7 Drawing Sheets

(51) Int. Cl.

| | |
|---|---|
| ***F04D 25/16*** | (2006.01) |
| ***F04D 29/58*** | (2006.01) |
| ***F04D 25/06*** | (2006.01) |
| ***F04D 13/06*** | (2006.01) |
| ***F04D 29/28*** | (2006.01) |
| ***F04D 29/22*** | (2006.01) |
| ***F04D 29/70*** | (2006.01) |
| ***F04D 29/40*** | (2006.01) |
| ***F04D 29/046*** | (2006.01) |
| ***F04D 29/05*** | (2006.01) |
| ***F04F 5/04*** | (2006.01) |
| ***F04D 1/00*** | (2006.01) |
| ***F04D 17/08*** | (2006.01) |
| ***E21B 43/36*** | (2006.01) |
| ***F04D 31/00*** | (2006.01) |

(52) U.S. Cl.

CPC ..... *F04D 13/12* (2013.01); *F04D 17/08* (2013.01); *F04D 25/06* (2013.01); *F04D 25/0686* (2013.01); *F04D 25/16* (2013.01); *F04D 29/046* (2013.01); *F04D 29/05* (2013.01); *F04D 29/22* (2013.01); *F04D 29/284* (2013.01); *F04D 29/40* (2013.01); *F04D 29/58* (2013.01); *F04D 29/70* (2013.01); *F04D 31/00* (2013.01); *F04F 5/04* (2013.01); *Y10T 137/2036* (2015.04); *Y10T 137/2562* (2015.04); *Y10T 137/2931* (2015.04); *Y10T 137/3003* (2015.04); *Y10T 137/87265* (2015.04)

(58) Field of Classification Search

CPC ..... F04D 29/70; F04D 29/05; F04D 29/284; F04D 29/58; F04D 29/0686; F04D 1/00; F04D 25/06; F04D 25/16; F04D 13/06; F04D 13/12; F04D 31/00; F04F 5/04; Y10T 137/2036; Y10T 137/3003; Y10T 137/2562; Y10T 137/87265; Y10T 137/2931

USPC ..... 415/169.2, 169.4, 116, 117; 166/357, 166/265, 267; 137/171

See application file for complete search history.

(56) References Cited

U.S. PATENT DOCUMENTS

| | | | | |
|---|---|---|---|---|
| 5,044,440 | A | 9/1991 | Stinessen et al. | |
| 5,188,196 | A | 2/1993 | Mezzedimi | |
| 5,207,291 | A | 5/1993 | Mezzedimi et al. | |
| 5,254,292 | A | 10/1993 | Gabryelczyk et al. | |
| 5,382,141 | A | 1/1995 | Stinessen | |
| 5,393,202 | A | 2/1995 | Levallois | |
| 5,398,762 | A | 3/1995 | Stinessen | |
| 5,417,544 | A | 5/1995 | Mohn | |
| 5,660,532 | A | 8/1997 | Castel | |
| 6,059,539 | A | 5/2000 | Nyilas et al. | |
| 6,065,486 | A * | 5/2000 | Vetterick | F22B 37/227 137/171 |
| 6,164,308 | A | 12/2000 | Butler | |
| 6,171,074 | B1 | 1/2001 | Charron | |
| 6,210,126 | B1 | 4/2001 | Charron | |
| 6,214,092 | B1 | 4/2001 | Odom et al. | |
| 6,267,560 | B1 | 7/2001 | Charron | |
| 6,273,674 | B1 | 8/2001 | Charron | |
| 6,296,690 | B1 | 10/2001 | Charron | |
| 6,546,962 | B1 | 4/2003 | Sunde | |
| 6,655,462 | B1 | 12/2003 | Carmichael et al. | |
| 6,773,235 | B2 | 8/2004 | Poorte et al. | |
| 6,907,933 | B2 | 6/2005 | Choi et al. | |
| 7,575,422 | B2 | 8/2009 | Bode et al. | |
| 7,654,328 | B2 | 2/2010 | Stinessen et al. | |
| 9,032,987 | B2 * | 5/2015 | Bjorge | E21B 43/01 137/110 |
| 2001/0005483 | A1 | 6/2001 | Charron | |
| 2004/0050549 | A1 | 3/2004 | Irwin, Jr. | |
| 2004/0086376 | A1 | 5/2004 | Baldassarre et al. | |
| 2004/0253120 | A1 | 12/2004 | Meuter | |
| 2005/0011646 | A1 | 1/2005 | Appleford et al. | |
| 2006/0151167 | A1 | 7/2006 | Aarvik et al. | |
| 2006/0157251 | A1 | 7/2006 | Stinessen et al. | |
| 2007/0131429 | A1 | 6/2007 | Brammer | |
| 2007/0172363 | A1 | 7/2007 | Laboube et al. | |
| 2007/0199696 | A1 | 8/2007 | Walford | |
| 2009/0200035 | A1 | 8/2009 | Bjerkreim et al. | |
| 2009/0321080 | A1 | 12/2009 | Breivik et al. | |

FOREIGN PATENT DOCUMENTS

| | | | |
|---|---|---|---|
| EP | 0989306 | A1 | 3/2000 |
| EP | 1487104 | A1 | 10/2004 |
| FR | 2774137 | A1 | 7/1999 |
| GB | 2209801 | A | 5/1989 |
| GB | 2239676 | A | 7/1991 |
| GB | 2264147 | A | 8/1993 |
| GB | 2337560 | A | 11/1999 |
| NO | 863630 | A | 3/1988 |
| NO | 168664 | B | 3/1989 |
| NO | 162782 | B | 11/1989 |
| NO | 169560 | A | 11/1990 |
| NO | 172075 | B | 2/1993 |
| NO | 172076 | B | 2/1993 |
| NO | 172555 | B | 4/1993 |
| NO | 172556 | B | 4/1993 |
| NO | 172605 | B | 5/1993 |
| NO | 173197 | B | 8/1993 |
| NO | 175877 | B | 9/1994 |
| NO | 305724 | B1 | 7/1999 |
| NO | 323240 | B1 | 11/1999 |
| NO | 20015199 | A | 4/2003 |
| NO | 20035398 | | 12/2003 |
| NO | 200349140 | A | 5/2004 |
| NO | 20041481 | A | 10/2004 |
| NO | 20052341 | A | 5/2005 |
| NO | 319600 | B1 | 8/2005 |
| NO | 20054621 | A | 10/2005 |
| NO | 200541980 | A | 10/2005 |
| NO | 323324 | B1 | 3/2007 |
| NO | 329089 | B1 | 8/2010 |
| WO | WO 92/14061 | A1 | 8/1992 |
| WO | WO 01/50024 | A1 | 7/2001 |
| WO | WO 02/099288 | A1 | 12/2002 |
| WO | WO 03/033870 | A1 | 4/2003 |
| WO | WO 03/035225 | A1 | 5/2003 |
| WO | WO 03/071139 | A1 | 8/2003 |
| WO | WO 2004/083644 | A1 | 9/2004 |
| WO | WO 2005/026497 | A1 | 3/2005 |

* cited by examiner

GAS COMPRESSION SYSTEM

CROSS-REFERENCE TO RELATED APPLICATIONS

This application is a Continuation of co-pending application Ser. No. 12/988,769 filed on Nov. 17, 2010, which is a National Stage application of PCT International Application No. PCT/NO2009/000126, filed Apr. 2, 2009. PCT/NO2009/000126 also claims priority under 35 U.S.C. §119(a) on Patent Application No. 20081911, filed in the Norway on Apr. 21, 2008. The entire contents of each of the above applications are hereby incorporated by reference.

THE TECHNICAL FIELD

The present invention relates to a system for wet gas compression, comprising a compact flow conditioner, a multi-phase flow meter and a downstream multi-phase compressor, preferably of the centrifugal compressor type, designed to be installed below sea level in the vicinity of a well head or on a dry installation, such as a platform or an onshore plant, the flow conditioner being designed to be supplied with multi-phase flow of hydrocarbons from a sub sea well, convey and preferably avoid accumulation or remove as much sand from said multi phase flow as possible.

BACKGROUND FOR THE INVENTION

Future sub sea installations will require equipment for increasing the pressure in the well flow in order to achieve optimum exploitation of the reservoir. Use of machines which increases the pressure, contribute to a reduction of the down hole pressure in the well. This will then lead to an accelerating production from the reservoir, providing a possibility for maintaining a stable flow regime through the well casing, so that formation of fluid plugs is avoided. Prior art solutions comprise use of pumps for pumping liquids (water and raw oil, etc.), and mixing of liquid and gas where the liquid represents more than 5 volume %, while compressors which are able to pump wet gas, are under development and testing. Today, compressors have limited capacity, and the increase in pressure and power are at maximum limited to a few megawatts. Hence, there is a need for development of compressor systems which may handle large volumes of gas having in part substantial pressure differences and with power up to several tens of megawatts.

The challenges to be met in this respect are amongst others transfer of large effect volumes below sea level; handling of sand, water, oil/condensate, and gas; together with possible pollution, such as production chemicals, hydrate inhibitors, pollutions from the reservoir; and uneven distribution of such matter over the life span of the field; liquid plugs during the start-up phase and transients, etc.

Solutions exit for such systems. All the systems have a common denominator, namely their dependence of the functioning of a number of components, having to work together in order to obtain the required system functionality. Many of these prior art components are not qualified for use in connection with offshore exploitation of oil.

GB 2 264 147 discloses a booster arrangement for boosting multi-phase fluids from a reservoir in a formation to a processing plant, where the boosting arrangement is placed in a flow line between the reservoir and the processing plant. The arrangement comprises a separation vessel for separation of liquid/gas, where said separation vessel has an inlet for supplying a mixture of oil and gas prior to further separate transport of the gas and the liquid. Further, the boosting arrangement comprises a motor driven pump, designed to lift the liquid fraction out of the scrubber and further to a jet pump, while the separated gas is allowed to flow through a separate pipe to said jet pump. From the jet pump, the mixed gas and liquid is then compressed to a processing plant at a substantially higher pressure than the pressure at the inlet to the separation vessel.

SUMMARY OF THE INVENTION

The flow conditioner is designed for receiving a multi-phase flow of mainly hydrocarbons from one or more sub sea wells, to transport and secure an even flow of gas and liquid to the wet gas compressor and preferably to avoid accumulation or remove as much sand as possible from said multi-phase flow. The presence of a well flow liquid through the entire compressor shall prevent formation of deposits, increase the pressure conditions in the machine, secure cooling of the gas during the compression stage and reduce erosion, since the velocity energy from possible particles is absorbed by the liquid film wetting the entire surface of the compression circuit.

An object of the present invention is to be able to handle large volumes of gas and accompanying smaller volumes of liquid, at partly substantial pressure differences between said two fluids.

Another object of the invention is to increase available power of the system by more than tens of megawatts.

A still further object of the invention is to reduce the number of critical components in the process system on the sea bed, and to make critical components more robust by introducing new technological elements. Such critical components or back-up functions are: anti-surge control valve, handling of the separation vessel liquid,
pump,
sand handling,
cooler,
volume measurements, and
control system.

A still further object of the invention is to improve the existing systems.

The compressor remains a vital part of the system, handling the pressure increase in the gas as its primary function. The compressor is designed to be robust with respect to gas/liquid flow conditioning, redundancy, several levels of barriers against failure and simplified auxiliary systems.

The compressor is installed in the vicinity of the sub sea production wells and shall deliver output to a single exit pipeline.

The objects of the present invention are achieved by a solution as further defined in the characterizing part of the independent claim.

Several embodiments of the invention are defined by the dependent patent claims.

According to the invention, a combined pump and compressor unit for transportation of gas and liquid from the flow conditioner to a multi-phase receiving unit is provided, such combined pump and compressor unit forming an integral part of the flow conditioner. The pump and compressor unit comprises one or more impellers functioning on the centrifugal principle and will in the following be denoted as the wet gas compressor. Such unit shall be in position to pressurize a well flow comprising of gas, liquid and particles. The wet gas compressor may be powered by a turbine, but is preferably powered by an electromotor integrated within the same pressure casing as the compressor, where process gas or the gas from the well flow is used for cooling the electromotor and the bearings. The hot gas used for cooling the electromotor may be transferred to places where there is a need for heating. This may in particular be relevant for the regulating valves in the system, such as for example the anti-surge valve, in order to prevent formation of hydrates or ice in valves which normally are closed.

An alternative embodiment of the wet gas compressor is to have a rotating and/or static separator for collecting the liquid in a rotating annulus, so that the liquid is given velocity energy which is transformed into pressure energy in a static system, such as a pitot, and that the pressurized liquid is fed outside and past the compressor part of the unit, and thereupon mixed again with the gas downstream of the unit.

The flow conditioner may preferably include a built-in unit in the form of a liquid separator and a slug catcher upstream of the combined compressor and pump unit. Further, the flow conditioner may be oblong with its longitudinal length in the fluid flow direction. If there is a need for cooling the gas prior to the compressor inlet, the flow conditioner may also include a cooler.

The function of such flow conditioner may be based on different principles. A technical solution is based on the feature that gas and liquid may be sucked up through separate ducts and mixed just upstream of the wet gas compressor. The liquid is sucked up and distributed in the gas flow by means of the venturi principle, where such effect preferably may be obtained by means of an constriction in the inlet pipe to the impeller, just upstream of the impeller, so that an increase of gas velocity may give sufficient under pressure, securing that the liquid is sucked up from the flow conditioner. Gas and liquid will thus form an approximate homogeneous mixture before reaching the first impeller. Corresponding functions may also be secured by using a flow conditioner where the liquid is separated out in a horizontal tank and where an increasing liquid height in the tank will secure more flow of liquid in the gas, since the flow area of the liquid is given by the holes in a vertically arranged perforated dividing wall. The mixing of gas and liquid as such will then be done in the flow conditioner and there will be a need for passing the gas and the liquid through a system for multiphase flow metering defining the volumes of gas and liquid passing through the inlet of the wet gas compressor. In addition to conventional control of anti-surge, such multiphase flow metering device must also secure slug control when the liquid increases substantially or is pulsating, this being detected by the multiphase meter, and a regulation valve is then opened (anti-surge valve) in order to secure recirculation of gas from the outlet back to the inlet of the wet gas compressor. If required, the control system secures that the revolutions per minute of the wet gas compressor is lowered.

The most essential advantage of the present invention is that liquid and gas is given increased pressure in one and the same unit. Thus, there is no need of conventional gas/liquid separation and the liquid pump may be omitted. A compression system may hence be made substantially simpler and may be produced at a substantially lower cost.

BRIEF DESCRIPTION OF THE DRAWINGS

A preferred embodiment of the invention shall in the following be described in further detail referring to the drawings, where.

DETAILED DESCRIPTION OF THE EMBODIMENTS

Figure 1:
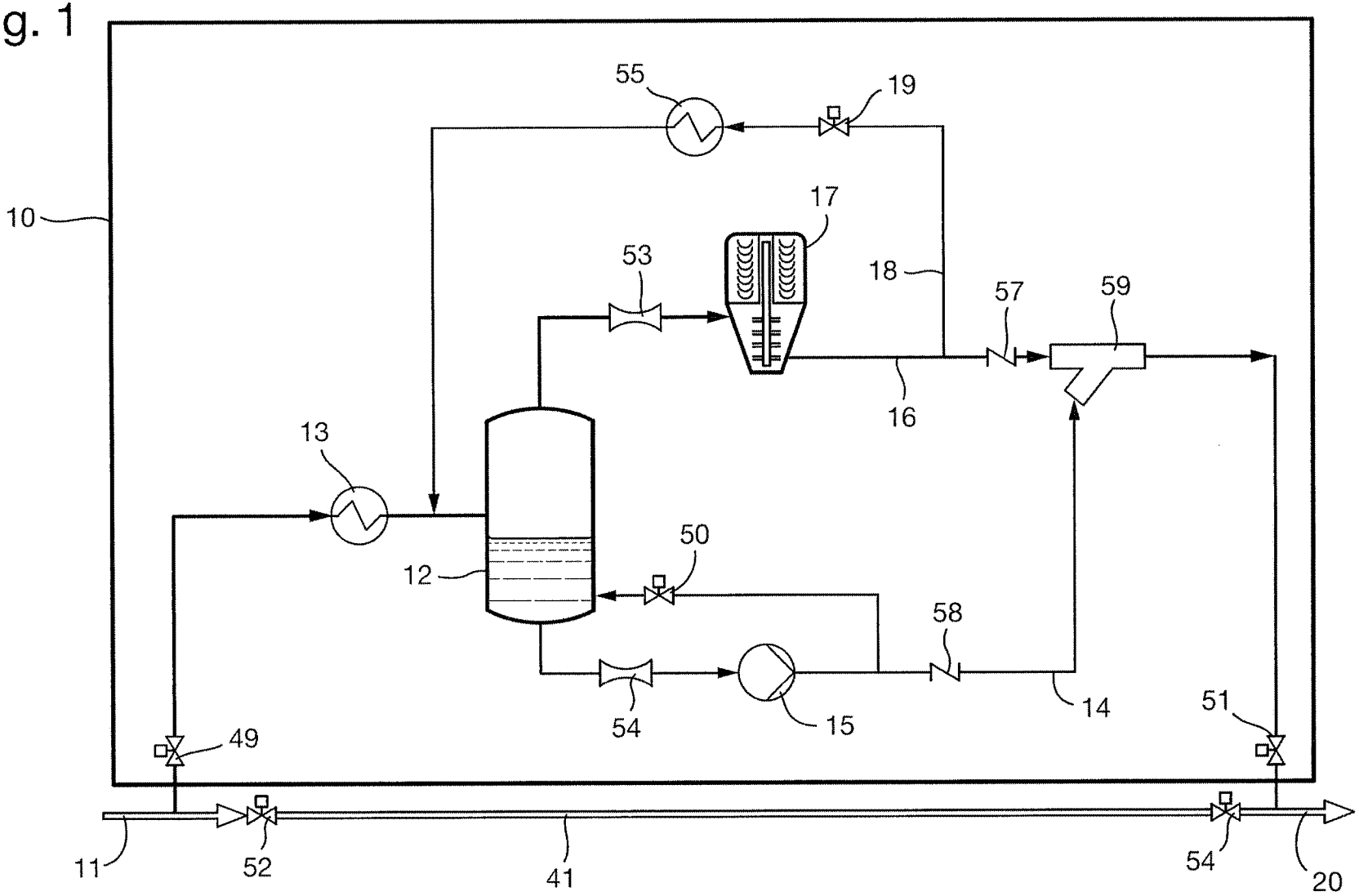
FIG. 1 shows schematically a diagram of a sub sea system according to the prior art.

FIG. 1 shows schematically a system diagram of sub sea compressor system 10 according to a prior art solution. According to the prior art solution the system comprises a supply line 11 where the well flow either may flow naturally due to an excess pressure in the well through the ordinary pipe line 41, when the valves 49 and 51 are closed, while the valves 52 and 54 are open, or through the compressor system when the valves 49 and 51 are open and the valves 52 and 54 are closed.

When the well flow is fed into the compressor system 10, the well flow is fed to a liquid scrubber or separator 12, where gas and liquid/particles are separated. Up front of the inlet to the liquid separator 12, a cooler 13 is arranged, cooling the well flow down from typically 70° C. to typically 20° C. before the well flow enters the liquid separator 12. The cooler 13 reduces the temperature of the well flow so that liquid is separated out and the portion of liquid is increased. This reduction of mass flow of gas which is fed into the compressor 17 reduces the power requirement in the compressor 17. The cooler 13 may in principle be placed upstream of the compressor 17, as shown in FIG. 1. A corresponding cooler may possibly also in principle be placed downstream of the compressor 17, thereby securing a temperature lower than the limiting temperature in the pipe line.

The liquid separated out in the separator 12 is then fed through a liquid volume metering device 54 and into the pump 15. The metering device 54 may alternatively be arranged upstream of the pump 15. Further, the liquid from the pump 15 is returned back to the separator 12 in desired volume by regulating a valve 50. Said circulation of liquid secures a larger operational range (larger liquid volumes) through the pump 15.

The gas separated out in the separator 12 is fed into a volume metering device 53 and then into the compressor 17. The compressor 17 increases the pressure in the gas from typically 40 bar to typically 120 bar. Downstream of the outlet from the compressor 17 a recirculation loop is arranged, feeding the gas through a cooler 55 and back to upstream of the separator 12 when the valve (anti-surge valve 19) is opened. The cooler 55 may optionally be integrated in the inlet cooler 13 by feeding re-circulated gas back upstream of the inlet cooler 13. Said re-circulation of gas increases the operational range of the compressor 17, and ensure that the volume of gas through the compressor 17 is sufficient during trip and subsequent closing of the machine. The pressure increase in the liquid by means of the pump 15 corresponds to the pressure increase in the gas through the compressor 17.

The gas coming from the compressor 17 is then fed through a reflux valve 57, while the liquid coming from the pump 15 goes through a non-return valve 58. Gas from the compressor 17 and liquid from the pump 15 are mixed in a Y-joint 59. The well flow goes further in the pipeline 20, bringing the well flow to a multiphase receiving plant (not shown). When required, a post-cooler (not shown) may be incorporated.

Figure 2:
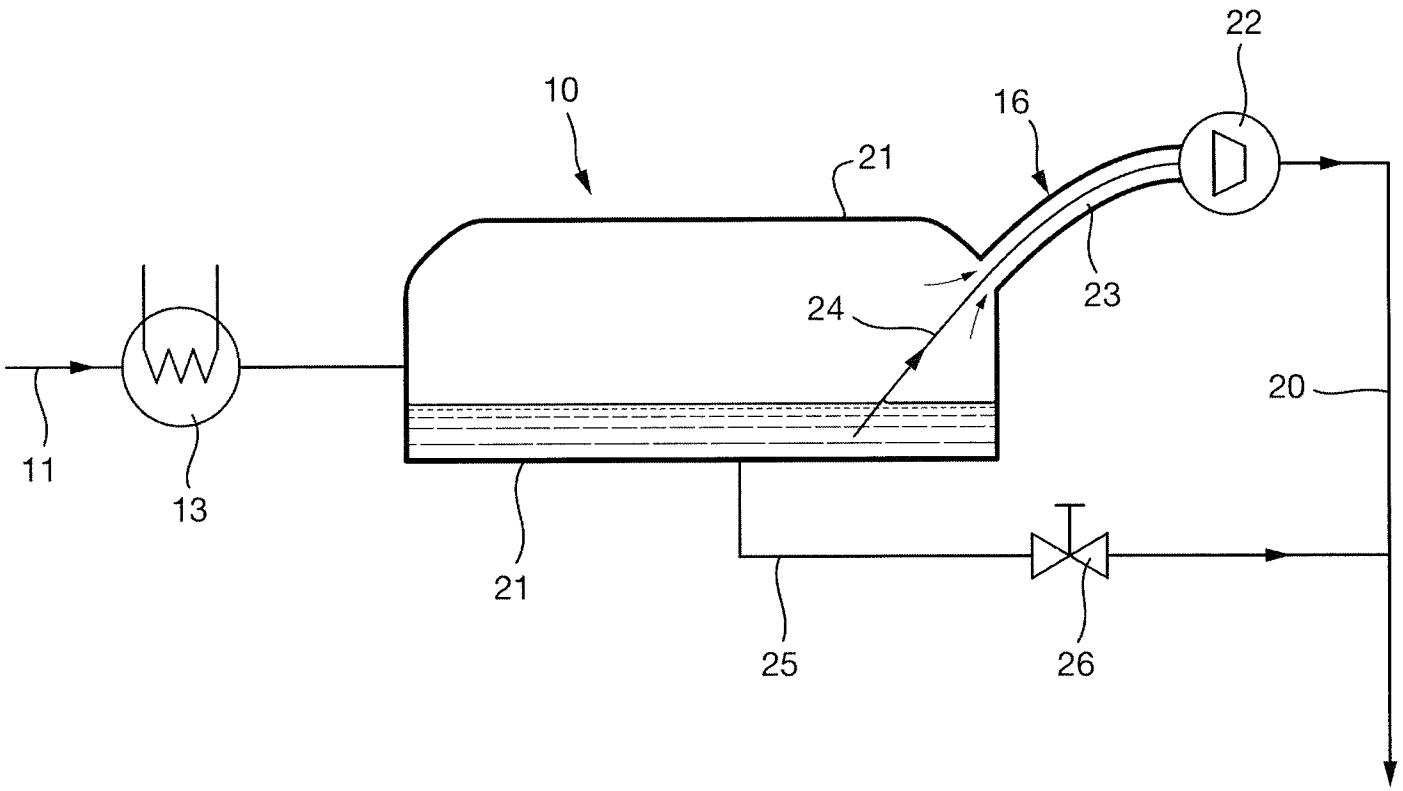
FIG. 2 shows schematically a diagram of a sub sea system including a flow conditioner according to the present invention, based on the venturi principle.

FIG. 2 shows a corresponding system according to the present invention. According to this solution, a multiphase flow from a well (not shown), including possible sand, is flowing through a supply line 11 into a flow conditioner 21 where the fluid flow from the well is stabilized by separating the liquid and the gas in said flow conditioner 21. The liquid is taken from the bottom of the flow conditioner 21 through an outlet pipe 24, while the gas is taken out at the top of the flow conditioner through an outlet pipe 23. As a consequence of such solution an outlet pipe 16 with two separate pipes 23,24 formed as an integral gas/liquid pipe 16 in the form of separate pipes for gas and liquid, is connected to a combined pump and compressor 22. The purpose of the combined pump and compressor unit 22 is to increase the pressure both in the gas and the liquid for further transport to a multiphase plant (not shown). This may be done, as indicated in FIG. 3, where gas and liquid is intended to be uniformly distributed and fed to a wet gas compressor 22 producing pressure increases in the gas and the liquid through same flow duct/impeller. Alternatively, this may be obtained as indicated in FIG. 4, where gas and liquid are separated at the inlet to the machine and where the gas fraction is fed to a standard gas compressor, while the separated liquid is given sufficient rotational energy so that the liquid may be transported out of the liquid chamber 44 with sufficient pressure to meet the pressure in the gas fraction at the exit from the compressor unit.

The outlet pipe 16 is in the form of a gas pipe 23 communicating with the upper, gas filled part of the flow conditioner 21, while an inner liquid pipe 24, having smaller diameter than the outlet pipe 16*b*, communicates with the lower, liquid filled part of the flow conditioner 21. The gas pipe 23 ends as shown in FIG. 3 in the inlet pipe of the compressor 22. The inner liquid pipe 24 exits in a spray nozzle 23', designed to distribute the liquid evenly into the gas. The gas pipe 23 is connected to the inlet flange on the compressor 22. The liquid spray nozzle 23 is arranged at the inlet flange, close to the impeller 35 of the compressor. From the combined pump/compressor 22 the multiphase flow is exported through a pipe 20 to a multiphase receiving unit (not shown). The outlet pipe from the combined pump and compressor unit 22 is shown in FIG. 2 and FIG. 4.

From the bottom of the flow conditioner 21, a second outlet pipe 25 for removal of sand is arranged, if required. When sand is to be removed, the combined compressor/pump unit 22 is preferably shut down. The pipe may for this purpose be equipped with a suitable valve 26. The pipe is connected in such way that if it is required to empty sand from the flow conditioner 21, the compressor is stopped, the valve (not shown) in the line 20 is closed and the valve 26 is opened while the pressure in the receiving plant is reduced.

In the same manner as shown for the prior art shown in FIG. 1, a cooler 13 is incorporated upstream of the flow conditioner 21. The purpose and temperatures are in essence corresponding to the purpose and temperatures for the prior art solution according to FIG. 1.

As shown in FIG. 2 an anti-surge valve may now be superfluous. A possible elimination of the anti-surge valve depends on the flow resistance characteristics of the pipeline and the characteristics of the compressor, and must be suitably adapted in each single case. The compressor characteristics have from recently performed analyses and tests shown to change for compressors which operate with two phases and because of internal re-circulation for motor cooling gas, so that the need for anti-surge flow rate is reduced.

The flow conditioner 21 according to the present invention may preferably be oblong in the direction of flow with a cross sectional area larger than that of the supply pipe 11, thus also contributing to enhanced separation of gas G and liquid L, and enhanced separation of possible sand in the flow.

The lowest point in the compressor may preferably be the compressor outlet and/or inlet. This secures simple draining of the compressor 22.

Figure 3A:
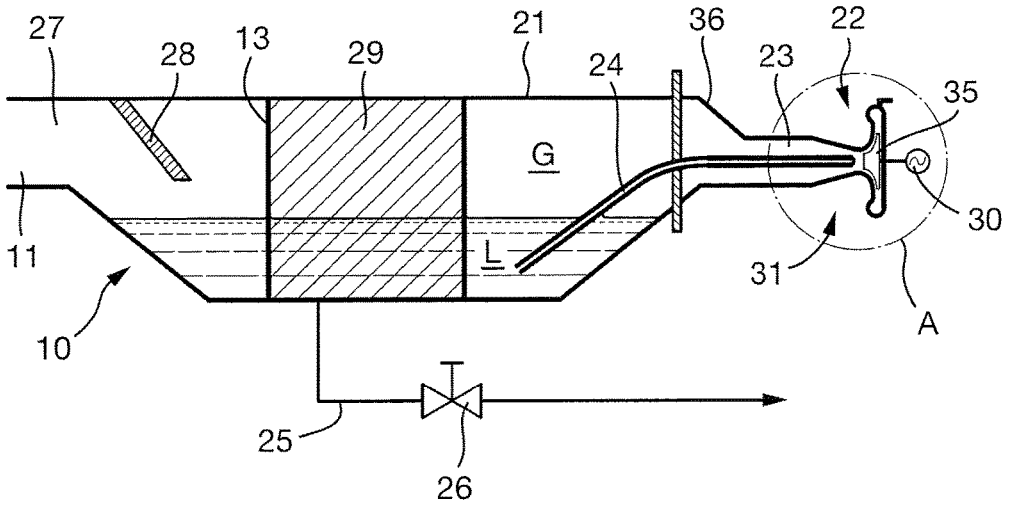
FIG. 3*a* shows schematically in further detail a unit according to the invention.
Figure 4:
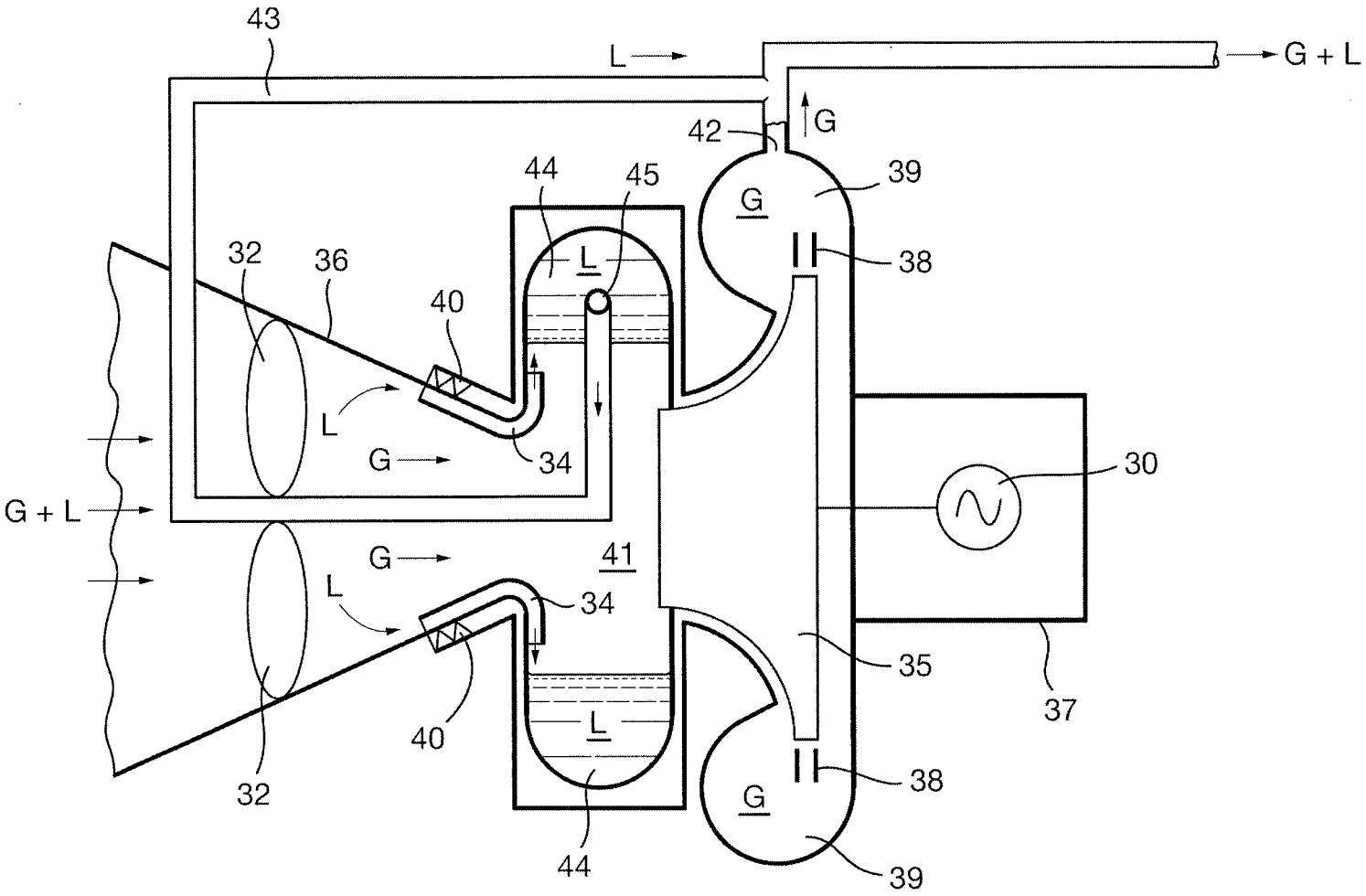
FIG. 4 shows schematically a detail of an alternative embodiment of a wet gas compressor according to the present invention.

FIG. 3*a* shows schematically details of the flow conditioner 21 according to the present invention, where gas G and liquid L firstly are separated in the separator upstream of the impeller 35 of the unit. The liquid L is sucked up and delivered through the inlet pipe 24, which at its one end is provided with a constriction or a spray nozzle 23. The liquid L is distributed as evenly as possible in the gas flow G by means of the venturi principle, caused by the constriction in the supply line 36 of the gas pipe. As shown, the flow conditioner 21 may be oblong. At one end of the flow conditioner an inlet pipe 27 is arranged, connected to the supply line 11. At this end a lead plate 28 is arranged in order to direct the fluid flow entering the flow conditioner 21 towards its bottom area. In the flow conditioner 21, the liquid L and sand will flow down towards the bottom of the unit 21 due to gravity and reduction in flow velocity within the flow conditioner 21, caused by the increased flow area, while the gas G remains in the upper part. Suitable, robust, insides 29 may be installed internally in the flow conditioner 21. This is an arrangement which increases the separation efficiency and evens out the liquid/gas flow. An important aspect is that said insides 29 preferably also may comprise a cooler, allowing omission of a cooler placed outside the flow conditioner 21, upstream of said flow conditioner 21.

According to the invention gas G is fed from the flow conditioner 21 to the combined pump and compressor unit 22 via a funnel shaped constriction 36, while the liquid L is sucked up through a pipe 24. The gas G and the liquid L is simultaneously presses/pumped further to a multiphase receiving plant (not shown).

The robust insides internally in the flow conditioner 21 may be in the form of a unit which optimizing slug levelling and forms basis for effective separation of liquid L and gas G, so the that liquid L and sand in a proper manner may be directed towards the bottom of the pipe.

Collected sand may periodically be removed from the flow conditioner 21 by means of an output pipe 25 and suitable valve 26.

An alternative for the use of a cooler 13, or as an addition, the compressor 22 may be installed at a distance from the well(s), forming sufficient surface area of the inlet pipe to achieve the necessary cooling of the fluid in the pipe by means of the surrounding sea water. This depends on a possible need for protection layer on the pipe and pipe dimension (need for trenching).

If process requirements or regularity require more than one compressor 22, then such compressors may be arranged in parallel or in series. If they are arranged in series, it may be possible to construct both compressors 22 so that the system characteristic always will be to the right of the surge line. Both compressors may still be a backup for each other. The need of the function of the anti-surge valve 19 will then diminish completely or partly. If it should be necessary to consider removing the need of an anti-surge valve 19, this will mean that a start up of the compressor may be done subsequent to more or less pressure equalizing of the pipe line. Surge detection, i.e. the lower limit for the stable flow rate of the compressor, is implemented so that by detection of too low flow rate, the compressor is closed down in order to avoid damage from mechanical vibrations. In order to protect the compressor during suddenly, unintentional down closing, necessary protective valve securing quick pressure equalizing between the inlet and outlet of the compressors may be considered.

The liquid L and particles may be transported out by means of the compressor 22 and a constriction 36 in the inlet pipe to the compressor 22 is arranged, so that liquid L is sucked up and evenly distributed to the compressor inlet.

Figure 3B:
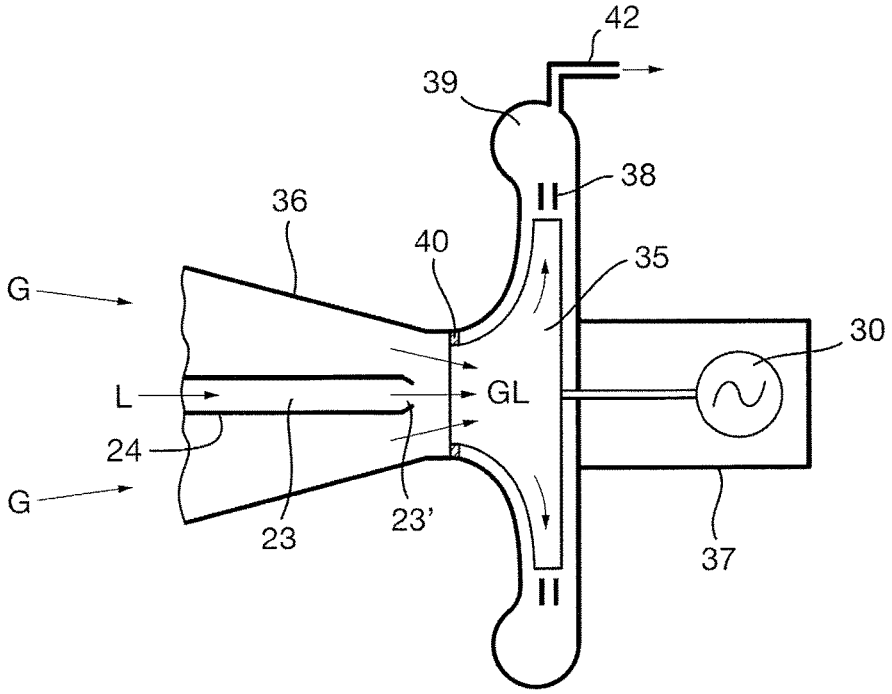
FIG. 3*b* shows in enlarged scale the featured indicated within the ring A in FIG. 3*a;*

FIG. 3*b* shows in an enlarged scale the outlet end of the flow conditioner 21, marked A in FIG. 3*a*. As shown in FIG. 3*b* the gas G is fed from the conditioner 21 into a funnel shaped constriction 36 which leads to one or more impellers 35 which is brought to rotate by means of a motor 30. Due to the funnel shaped constriction 36 and the shape of the opening in the impeller 35, and also due to the rotation of the impeller 35, the liquid is in addition sucked up through the supply pipe 24 and exit through the liquid spray nozzle 23, formed of a constriction at the end of the supply pipe 24. In the impeller 35 the mixture of liquid L and gas G is radially fed out through the diffuser 38 and out into an annulus 39 surrounding the impeller. From the annulus 39 the multi-phase flow is forced out at a very high pressure through a pipeline (not shown) to a multiphase receiving station (not shown). At the end of the impeller 35 facing the funnel shaped constriction 35, a seal 40 is arranged preventing unintended leakage of gas/liquid. Mechanical means such as bearings for the impeller 35, suspension means of the supply pipe 24 etc. are not shown. The motor 30 and the compressor 22 may preferably be directly connected to each other and mounted in a common pressure vessel 37, avoiding rotating seals towards the environment. The motor 30 may be powered by electricity, hydraulics or the like.

FIG. 4 shows an embodiment where the liquid L is fed to a 0'th step comprising a spinning element 32, hurling the liquid L out towards the periphery of the constricted pipe 36 and further to a rotating chamber 44. Upstream of the rotating chamber 44 spinning elements 32 may be arranged, said spinning element either may be in the form of a stationary or rotating separator. The separating spinning element 32 separates the liquid L and the gas G, the gas G being brought to move ahead to the impeller 35 and the annulus 39 via a diffuser 38, while the liquid L is brought to flow through the inlet 34 to the rotating chamber 44. The inlet to the rotating chamber 44 may be provided both with internally arranged mean 32 for separation of the liquid phase with particles from the gas phase, and an annulus shaped supply duct 34 for transport of liquid in to the rotating chamber 44. The liquid L in the rotating chamber 44 is pressed out of the rotating chamber 44 through the opening 45 in the combined outlet pipe/pitot tube 43. The opening 45 is placed in such way that the opening is arranged in the section of the rotating chamber 44 being filled with liquid L. The exit pipe 43 for the liquid from the rotating chamber 44 is in fluid communication with the outlet 42 from the annulus 39 of the compressor. The purpose is to separate liquid L from the gas G just in front of the gas impeller 35 and to make the liquid rotate, i.e. to give the liquid L sufficient kinetic energy so that the kinetic energy may be recovered in a diffuser or a pitot tube and transform such energy into pressure energy. The connection between the rotating chamber 35 and the stationary unit 36 is provided with sealing means 40 allowing relative movement between the two parts 35,36. For such solution the pressurized liquid L will bypass the compressor unit 35, whereupon gas G and liquid L is re-mixed together downstream of the unit.

As for the embodiment shown in FIG. 3, the annulus 29 according to the present invention is also provided with a diffuser 38, arranged downstream of the exit from the impeller 35.

The rotating liquid chamber 44 will be selfregulating in that when liquid is increasingly filled into the liquid chamber 44, the pressure at the liquid collection point will increase, thus forcing the liquid towards the compressor outlet. In such manner an increase in the liquid volume will also increase the pump capacity, so that the liquid level in the flow conditioner 21 is kept within acceptable limits.

According to this embodiment the rotating chamber 44 rotates together with the impeller 35.

Figure 5:
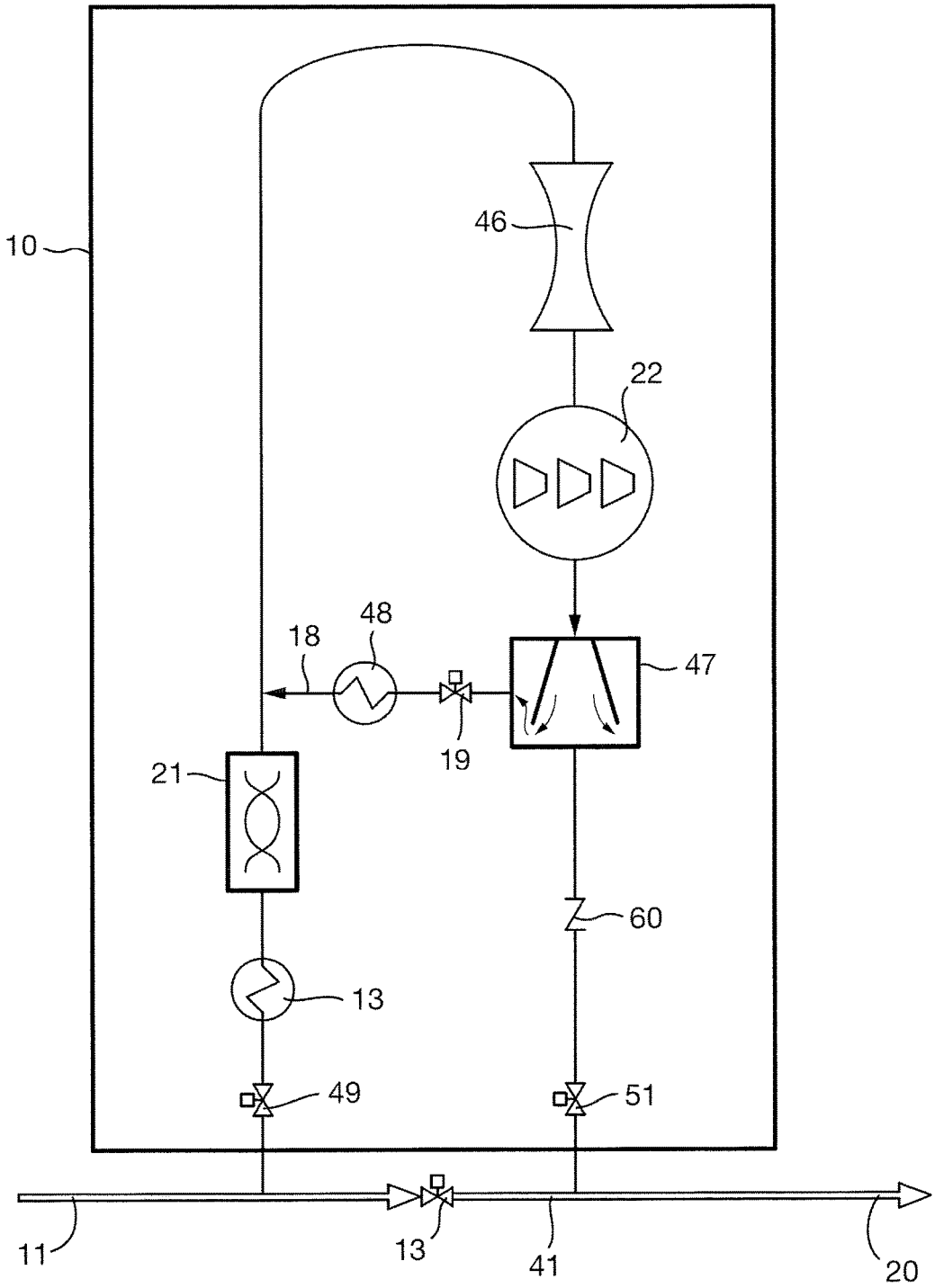
FIG. 5 shows a generic sub sea system according to the present invention, where a multiphase meter is used for measuring the volume of gas and liquids at the inlet of the wet gas compressor, thus providing data used in a conventional anti-surge control system, and a recirculation loop (anti-surge line) and where the flow conditioner is based on separation the gas and liquid and providing a controlled re-entrainment of the liquid into the gas within the tank.

FIG. 5 shows a corresponding sub sea system 10 according to the invention. A well flow consisting of gas, liquid and particles arrives through the pipe line 11, of which a natural flow from the well is secured when the valve 130 is open and the valve 49 and 51 are closed. Production from the well may be increased by letting the flow from well flow in the sub sea system 10 by opening the valve 49 and the valve 51, while the valve 130 is closed. Upstream of the inlet to the flow conditioner 21 a cooler 13 is arranged, cooling the well flow down from typically 70° C. to typically 40° C. The cooler 13 reduces the temperature in the well flow so that liquid is separated out and the liquid portion is increased. This increase in liquid volume may in certain cases result in increased effect consumption in the wet gas compressor 22, so that the cooler 13 in such cases must be moved downstream of the wet gas compressor 22 in order to secure temperatures lower than the limiting temperature of the pipeline. The cooler 13 may in principle be based on natural convection cooling from the surrounding sea water or based on forced convection. A multi-phase flow meter 46 is located between the wet gas compressor 22 and flow conditioner 21. The multiphase flow meter 46 measures the volume of gas and liquid flowing into the wet gas compressor 22. At substantial liquid rates or pulsating supply of fluid, this may be detected by the multiphase flow meter 46, so that the regulating valve 19, (the anti-surge valve) opens, securing increased volume of gas and a stable flow regime inside the machine. A gas output unit 47 downstream of the compressor secures that a very small volume of liquid circulates back to the wet gas compressor 22 through the recirculation loop 18. Alternatively, a cooler 48 may be included in the recirculation loop 18, so that it may be possible to operate the wet gas compressor, while the valves 49 and 51 are closed, i.e. no supply of well flow to the sub sea system 10. It will also be possible to eliminate the cooler 48 by placing the recirculation loop 18 upstream of the cooler 13. According to the present invention the wet gas compressor 22 functions as a combined pump and compressor so that the sub sea system 10 shown in FIG. 5 is simplified compared to the conventional system described in FIG. 1. The wet gas compressor 22 shown in FIG. 5 comprises one or more impellers based on the centrifugal principle, set to rotate by an integrated powering unit, such as for example a turbine or an electromotor. The presence of liquid through the wet gas compressor 22 may change the operation window (surge line) of the wet gas compressor 22 and it will be important to continuously monitor possible low vibration frequencies, less than the running frequency of wet gas compressor shaft, by applying a Fast Fourier Transform analysis of the vibration signal from the rotor, which also may be measured by means of an accelerometer on the exterior of the machine housing. In such way the sub-synchronous level of vibration (frequency of vibration lower than the frequency of rotation) may be used to open the control valve 19 in order to secure increased flow of gas at the inlet of the wet gas compressor 22. Further, the presence of liquid at the inlet of the wet gas compressor 22 will increase the pressure ratio across the machine as a consequence of increased bulk density of the fluid. Erosion from particles is reduced since the liquid wets the rotating surfaces and prevents direct impact between the particles and the impeller. Still further, the liquid will distribute evenly in radial direction through an impeller based on the centrifugal principle, while the liquid at the same time is transferred into small droplets which easily may be transported by the gas flow. Such small droplets will at the same time secure a large interface area (surface area of contact) between the gas and the liquid so that the gas effectively may be cooled by the liquid during compression through the wet gas compressor 22. Such cooling of the gas during compression will reduce the power requirements while the outlet temperature from the wet gas compressor 22 at the same time will be lower than for a conventional compressor. A formation of a surface layer in the compressor 17 will normally be experienced in a conventional compressor system shown in FIG. 1, caused by small volumes of liquid arriving with gas containing particles which adheres to the inner surfaces of the compressor 17 when the liquid is evaporated as a consequence of increased temperature across the compressor 17. In a wet gas compressor 22 shown in FIG. 5, the volume of liquid will be significant and normally being in the range of 1-5 volume percentage at the inlet. This will secure that liquid is present across the entire machine, thus eliminating formation of a surface layer.

A reflux valve 60 is placed downstream of the wet gas compressor 22, preventing backflow of gas and liquid into the wet gas compressor 22. The pressurized well flow is then directed back to the pipe line 20 through the opened valve 51 for further transport to a suitable receiving plant (not shown).

Figure 6:
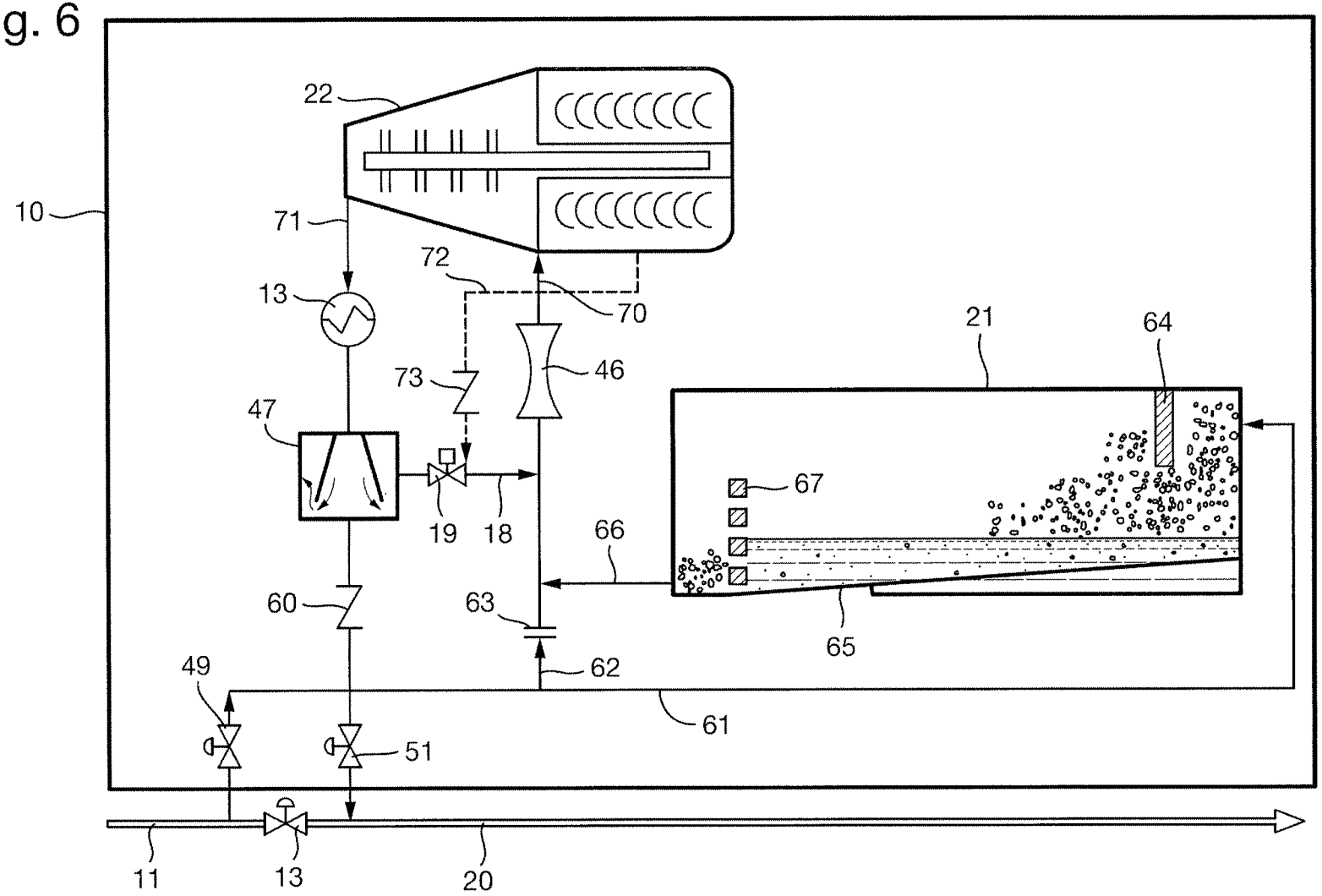
FIG. 6 shows a detailed sub sea system according to the present invention where the wet gas compressor is powered by an electromotor and where the process gas is used for preventing formation of hydrate and ice downstream of the anti-surge valve.

FIG. 6 shows a sub sea plant 10 according to the present invention, based on the main components shown in FIG. 5, but shown in further detail. A well flow comprising gas, liquid and particles is directed into the sub sea plant 10 through the pipeline 11 and the main valve 49, and then flowing through the pipe 61 which may be horizontal, but preferably slightly inclined so that a flow back towards the main line 11 is catered for during standstill. A vertical pipe 62 extends from the top of the horizontal pipe 61 and goes to a constriction 63 which preferably may be represented by an orifice plate or a valve. A minor part of the gas at the top of the horizontal pipe 61 will flow into the vertical pipe 62, while the major part of well flow will continue to the flow conditioner 21 due to less flow resistance, and then to be mixed with the gas coming from the vertical pipe 62 downstream of the flow conditioner 21.

Figure 7:
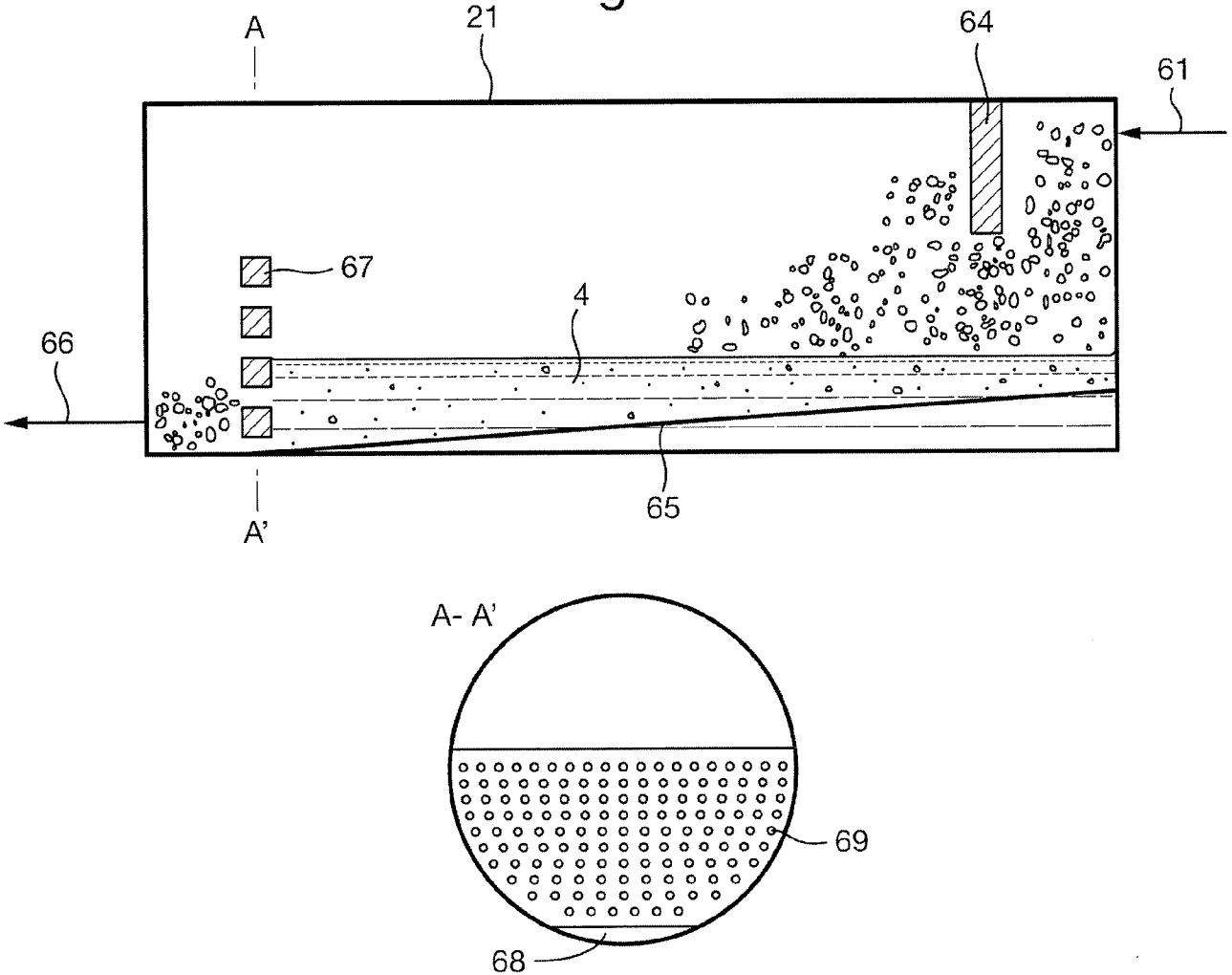
FIG. 7 shows in a more detail a schematic disclosure of the flow conditioner used in the system shown in FIGS. 5 and 6.

The flow conditioner 21 in FIG. 6 is disclosed in more detail in FIG. 7. The pipe 61 leads to the flow conditioner 21, which preferably is in the form of a cylindrical, elongated tank. The velocity of the gas is substantially reduced due to the increased area of flow together with use of a wall 64, securing that liquid and particles are allowed to settle in the tank 21. The bottom 65 of the flow conditioner 21 may be inclined downwards towards the outlet pipe 66 in order to secure that particles are not accumulated inside the tank 21, alternatively the entire flow conditioner 21 may be inclined correspondingly with respect to a horizontal plane, thus meeting said function of the bottom 65. Liquid and particles separated out in the tank 21 will meet a perforated wall 67 shown in more detail in the section A-A' in FIG. 7, provided with a large number of small holes 69 through which the liquid will flow and then subsequently re-mix with the gas upstream of the outlet pipe 66. Between the bottom of the flow conditioner 21 and the perforated plate 67 an opening 68 as shown in FIG. 7 is arranged, intended to secure that sand and other particles do not separate out and accumulate or build-up in the tank 21, but is forced out together with the liquid through the outlet pipe 66. The function of the flow conditioner 21 is secured in that a quick change in liquid volume at the inlet pipe 61 in FIG. 6 will be smoothened out due to a change in liquid level inside the tank 21. As the level increases inside the flow conditioner 21 the liquid will flow through more and more holes 69 in the perforated wall 67, thereby increasing the supply of liquid to the outlet pipe 66.

Gas and liquid coming from the vertical pipe 62 and the flow conditioner 21 in FIG. 6 then flow through a vertical multi-phase flow meter 46, metering the flow rates for gas and liquid. A wet gas compressor 22 in FIG. 6 (horizontal in the Figure, but may have any orientation) which comprises one or more impeller based on the centrifugal principle, driven by an electromotor forming part of the wet gas compressor 22, receives the well flow from a vertical pipe 70 from its bottom side. The pressure increases then in the well flow through the wet gas compressor 22 and is then fed into a vertical pipe 71 arranged towards the bottom side of the wet gas compressor 22. The purpose of a vertical inlet pipe 70 is to secure good drainage of liquid from the wet gas compressor 22 during a stop, and correspondingly from the multi-phase flow meter 46 and the flow conditioner 21 with associated pipe system through the orifice plate 63 and down into the pipe 61, ending into the main pipe 11. In the same manner the liquid may also be drained out from the exit side of the wet gas compressor 22 during stop so that liquid from the outlet pipe 71, the cooler 13, gas exit unit 47, reflux valve 60, and valve 51 with associated pipes is flowing in a natural manner back to the main pipe 20. The gas exit unit 47 secures that very small volumes of liquid are re-circulated back upstream of the multi-phase flow meter 46. Such re-circulation loop 18 is normally used for increasing the volume of gas flow through the wet gas compressor 22 during stop or start of the wet gas compressor 22, but also in situations where the multi-phase flow meter 46 detects unusually high level of liquid or possibly an unstable pulsating liquid rate. The regulating valve 19 will also open if the appearing vibration frequencies are lower than the running frequency of the wet gas compressor shaft, which could indicate that re-circulation of gas occurs in one or more of the stationeries or rotating parts inside the wet gas compressor 22. According to prior art technology, process gas is used for cooling the electromotor and the bearings and is supplied from the wet gas compressor 22 in order to secure an over-pressure in these parts compared to the pressure at the inlet of the wet gas compressor 22. Such cooling gas extracted from the wet gas compressor 22 may contain liquids and particles since the wet gas compressor 22 is boosting an unprocessed well stream mixture. Such particles being magnetic may deposit and accumulate inside the electromotor and in and on the bearings. It is therefore proposed to use an arrangement where permanent magnetic elements are incorporated into the pipe wall or by incorporating a separate chamber in order to collect such magnetic particles prior to feeding the process gas into the area of the electromotor and the bearings. In this manner deposits of magnetic particles in the electro-motor or the bearings used in the wet gas compressor 22 are avoided. The hot gas which has been used to cool the electromotor may be fed from the electromotor in a pipe 72 through a reflux valve 73 and into the pipe downstream of the regulating valve 19 (the anti-surge valve) in order to secure that formation of hydrates or ice are avoided during normal operation when the regulation valve is closed. Optionally the hot gas may be fed in to a heating jacket surrounding the regulation valve 15 in order to heat up the entire valve 15, if necessary, prior to feeding the hot gas in downstream of the regulation valve 15. The pressurized well flow will thus be sent from the sub sea plant 10 via the main pipe line 20 to a suitable receiving plant (not shown).

What is claimed is:

1. A gas compression system comprising:

a compact flow conditioner in a form of a flow conditioner tank, configured to be placed below a sea level in close vicinity to a well head or on a dry installation, said flow conditioner tank being configured to receive a multi-phase flow of hydrocarbons through a supply pipe from a sub sea well for further transport of the hydrocarbons to a multi-phase receiving plant;

a combined multi-phase pump and compressor unit comprising an impeller configured to compress a mixture of gas and liquid, the impeller functioning on a centrifugal principle such that the gas and the liquid are given increased pressure in the same combined multi-phase pump and compressor unit; and an outlet pipe connected to the flow conditioner tank at a first end and to the combined multi-phase pump and compressor unit at a second end, opposite to the first end, the outlet pipe being in a form of a constriction communicating with an upper, gas-filled part of the flow conditioner tank and a liquid pipe, the liquid pipe has a smaller diameter than the outlet pipe, the liquid pipe communicates with a lower, liquid-filled part of the flow conditioner tank and extends into the outlet pipe proximate to the impeller, wherein the gas compression system is configured such that the gas and the liquid are separated in the flow conditioner tank, the separated gas and liquid are sucked up through the separate gas and liquid pipes and re-mixed again upstream of the impeller, and the liquid is distributed in a gas flow by Venturi effect, and wherein the Venturi effect is obtained by the constriction in the outlet pipe to the impeller.

2. The gas compression system according to claim 1, wherein the flow conditioner tank is in a form of a horizontal cylinder having a larger diameter than a diameter of the supply line from the well, and having a longitudinal direction parallel to a fluid flow direction.

3. The gas compression system according to claim 1, wherein the combined pump and compressor unit comprises a rotating impeller.

4. The gas compressor system according to claim 1, wherein the flow conditioner tank is provided with an inherent cooler for reduction of dimensions and complexity of the gas compressor system for the fluid to exchange heat with surrounding sea water.

5. The gas compression system according to claim 1, wherein the flow conditioner tank comprises a second outlet pipe for removal of sand when required through a separate valve.

6. The gas compression system according to claim 1, wherein the flow conditioner tank is provided with at least one internally arranged flow influencing element, securing an even supply of liquid.

7. The gas compression system according to claim 1, wherein an arrangement of permanent magnets is utilized to collect magnetic particles from an extracted process flow stream from a process system, but not limited to the combined multiphase pump and compressor unit prior to feeding the processed gas to an electromotor and bearings.

8. The gas compressor system according to claim 1, further comprising a heating line into an anti-surge valve in order to prevent formation of hydrates by using hot cooling gas from motor cooling.

9. The gas compression system according to claim 8, further comprising a liquid removal unit configured to avoid recycling of liquid while utilizing an anti-surge line.

10. A method of flow conditioning by a gas compression system, the method comprising the steps of:

receiving a multi-phase flow of hydrocarbons in a compact flow conditioner through a supply pipe from a sub sea well for further transport of the hydrocarbons to a multi-phase receiving plant, the flow conditioner being in a form of a flow conditioner tank below a sea level in close vicinity to a well head;

separating, in the flow conditioner tank, liquid and gas from the multi-phase flow;

sucking up the separated liquid and the gas via an outlet pipe connected to the flow conditioner tank at a first end and to an impeller at a second end, opposite the first end, the outlet pipe being in a form of a constriction communicating with an upper, gas-filled part of the flow conditioner tank and a liquid pipe, the liquid pipe has a smaller diameter than the outlet pipe and communicates with a lower, liquid-filled part of the flow conditioner tank and extends into the outlet pipe proximate to the impeller;

re-mixing the liquid and the gas upstream of the impeller, wherein the liquid is distributed in a gas flow by Venturi effect where the Venturi effect is obtained by the constriction in the outlet pipe to the impeller;

boosting by a combined multiphase pump and compressor unit the re-mixed gas and liquid as a mixture, wherein the combined multiphase pump and compressor unit comprises the impeller, which functions on a centrifugal principle such that within a same rotational movement, both, the gas and the liquid are given an increased pressure in the same combined multiphase pump and compressor unit; and transporting the liquid and the gas from the combined multiphase pump and compressor unit to a remote multi-phase receiving plant.

* * * * *